US009200798B2

(12) United States Patent
Yao

(10) Patent No.: US 9,200,798 B2
(45) Date of Patent: Dec. 1, 2015

(54) LAMP STRUCTURE FOR A CEILING FAN

(71) Applicant: Chao-Chin Yao, Taichung (TW)

(72) Inventor: Chao-Chin Yao, Taichung (TW)

( * ) Notice: Subject to any disclaimer, the term of this patent is extended or adjusted under 35 U.S.C. 154(b) by 127 days.

(21) Appl. No.: 14/104,021

(22) Filed: Dec. 12, 2013

(65) Prior Publication Data

US 2015/0167958 A1 Jun. 18, 2015

(51) Int. Cl.

| | |
|---|---|
| ***F21V 33/00*** | (2006.01) |
| *F21V 29/67* | (2015.01) |
| *F04D 25/08* | (2006.01) |
| *F21Y 101/02* | (2006.01) |

(52) U.S. Cl.

CPC ..... *F21V 33/0096* (2013.01); *F04D 25/088* (2013.01); *F21V 29/67* (2015.01); *F21Y 2101/02* (2013.01)

(58) Field of Classification Search

CPC ..... F21V 29/67; F21V 33/0096; F21V 29/67; F21D 25/088; F21Y 2101/02

USPC ..... 362/249.02, 147

See application file for complete search history.

(56) References Cited

U.S. PATENT DOCUMENTS

| | | | | |
|---|---|---|---|---|
| 5,658,120 | A * | 8/1997 | Watanabe | 414/495 |
| 6,174,077 | B1 * | 1/2001 | Bucher et al. | 362/438 |
| 7,824,068 | B2 * | 11/2010 | Wulfinghoff | 362/247 |
| 8,967,821 | B2 * | 3/2015 | Pickard | 362/84 |
| 2012/0020057 | A1 * | 1/2012 | Lin | 362/147 |

* cited by examiner

*Primary Examiner* — Anabel Ton

(74) *Attorney, Agent, or Firm* — Rosenberg, Klein & Lee

(57) ABSTRACT

A lamp structure for a ceiling fan has a connecting part at the top of its lamp base to connect to a ceiling fan. An installing part has at least two slant surfaces facing obliquely downward when the lamp base is connected to the ceiling fan. The slant surfaces are symmetric with respect to the lamp base. Each of the slant surfaces has a light-emitting diode whose light-emitting direction is also obliquely downward as the corresponding slant surface.

15 Claims, 6 Drawing Sheets

LAMP STRUCTURE FOR A CEILING FAN

BACKGROUND OF THE INVENTION

1. Field of Invention

The invention relates to a lamp structure and, in particular, to a lamp structure installed on a ceiling fan.

2. Related Art

FIG. 6 shows a conventional ceiling fan 91 whose bottom part has a lamp 92 that includes a lamp mask 921 and a circuit board 922 therein. The circuit board 922 is provided with a light-emitting diode (LED) 923. The LED 923 emits light when the circuit board 922 is turned on, illuminating the area underneath the ceiling fan 91.

However, the LED 923 on the circuit board 922 faces the ground directly. Although a normal LED 923 on the market has its own light-emitting angle, the widest angle does not cover a range beyond 160 degrees. The illuminated region is underneath the LED 923. Moreover, the light intensity gets weaker as the covered angle becomes larger. It is desirable to improve such a long-standing problem.

SUMMARY OF THE INVENTION

An objective of the invention is to provide a lamp structure for a ceiling fan which enables the lamp installed on the ceiling fan to illuminate a wider area with a more homogeneous intensity.

The disclosed lamp structure includes: a lamp base whose top part has a connecting part to connect to the ceiling fan, and an installing part having at least two slant surfaces symmetric with respect to the lamp base and facing obliquely downward when the lamp base is connected to the ceiling fan; wherein each of the slant surfaces is installed with at least one LED, and the light-emitting direction of each of the LED's is obliquely downward as the corresponding slant surface.

BRIEF DESCRIPTION OF THE DRAWINGS

These and other features, aspects and advantages of the invention will become apparent by reference to the following description and accompanying drawings which are given by way of illustration only, and thus are not limitative of the invention, and wherein.

DETAILED DESCRIPTION OF THE INVENTION

The present invention will be apparent from the following detailed description, which proceeds with reference to the accompanying drawings, wherein the same references relate to the same elements.

Figure 1:
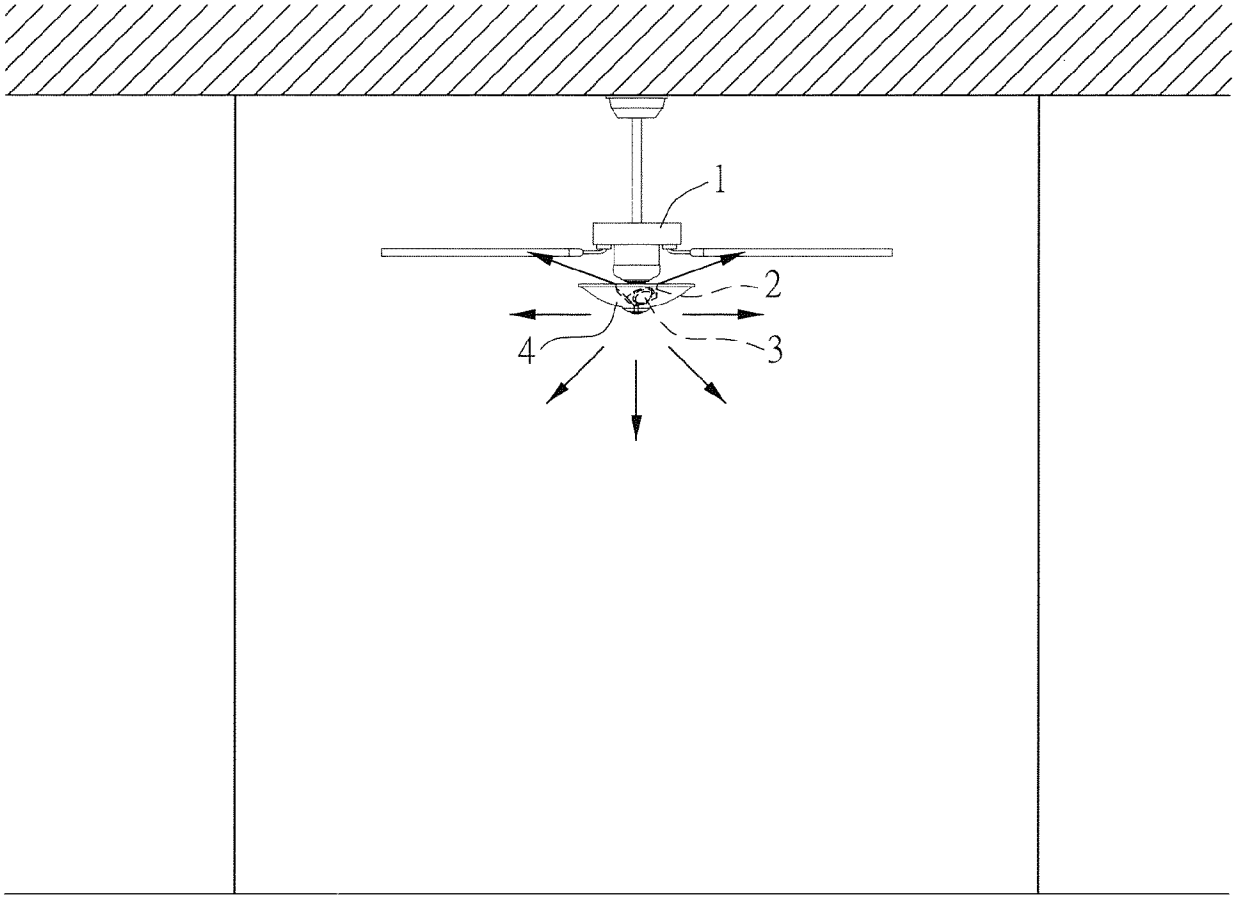
FIG. 1 is a side view of the disclosed lamp structure installed on an indoor ceiling fan, where one observes that the light-emitting angle of the LED's reaches the lamp base.
Figure 2:
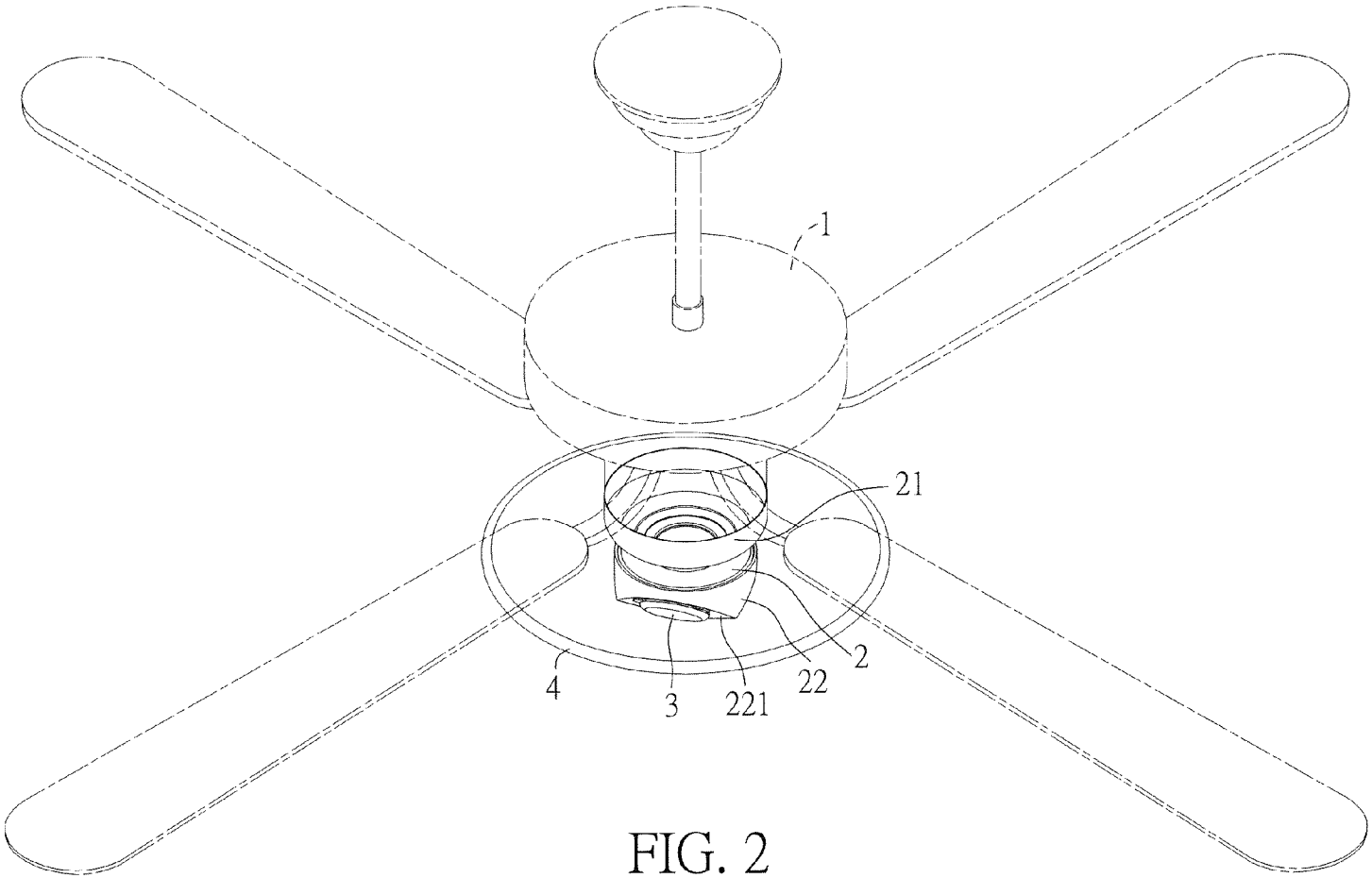
FIG. 2 is a three-dimensional perspective view of the disclosed lamp structure on a ceiling fan.

Please refer to FIGS. 1 to 5 for an embodiment of the disclosed map structure for a ceiling fan. As shown in FIG. 1, the embodiment is installed on the ceiling fan 1 for illumination. As shown in FIG. 2, it includes a lamp base 2, several LED's 3, and a lamp mask 4.

Figure 3:
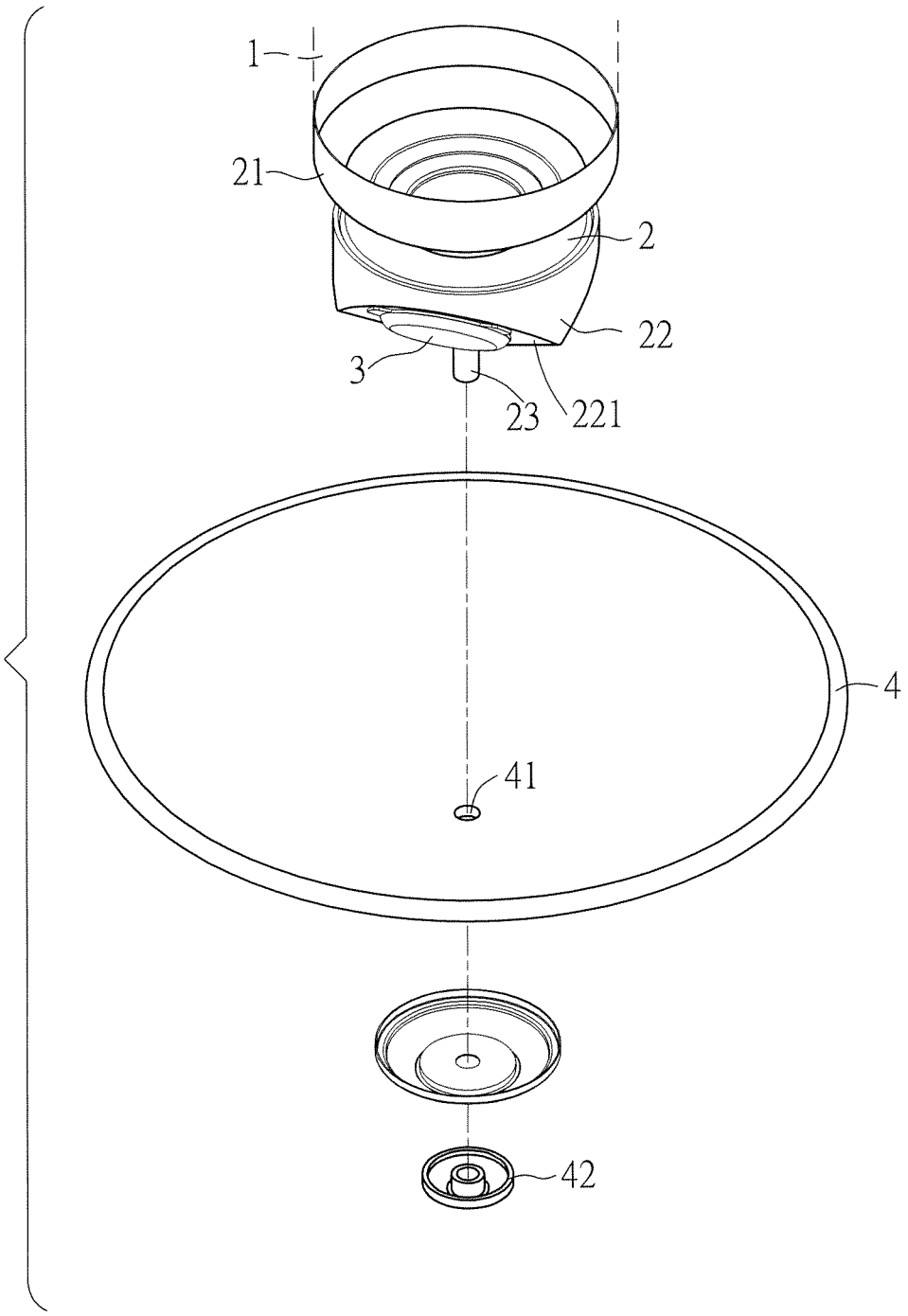
FIG. 3 is a three-dimensional exploded view of the disclosed lamp structure.
Figure 4:
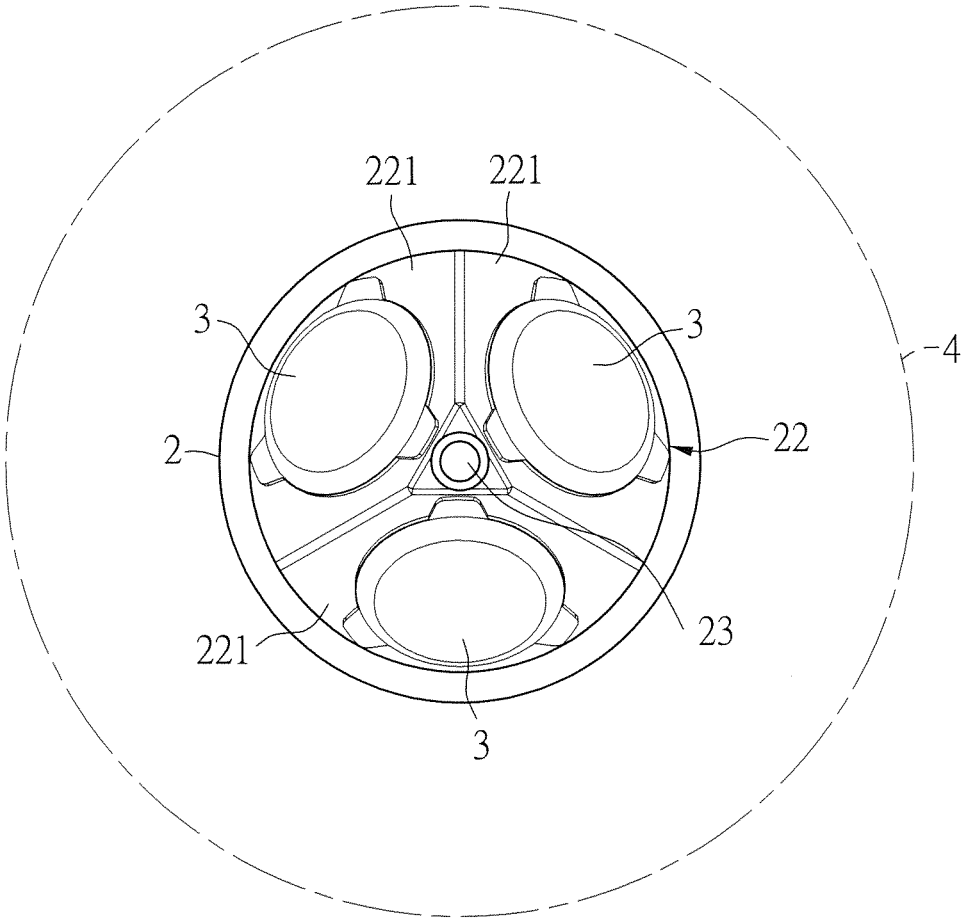
FIG. 4 is a bottom view of the invention showing that three slant surfaces are formed on the installing part in a symmetric way on a ring.

As shown in FIGS. 1 to 3, the top part of the lamp base 2 has a connecting part 21 to connect to the ceiling fan 1 and an installing part 22. With reference to FIG. 4, the installing part 22 in this embodiment has a triangular conic shape with three slant surfaces 221. Each of the slant surfaces 221 is obliquely downward when the lamp base 2 is connected to the ceiling fan 1. The three slant surfaces 221 are provided symmetrically around the lamp base. In this embodiment, the slant surfaces 221 have an angle of 45 degrees with respect to the horizon. As shown in FIGS. 1 to 3, each of the slant surfaces 221 is provided with an LED 3. The light-emitting direction of each of the LED's 3 is also obliquely downward as the corresponding slant surface 221.

With reference to FIG. 3, the bottom part of the lamp base 2 in this embodiment has a rod part 23 extending downward. The lamp mask 4 has a through hole 41 going through the center thereof. When the lamp mask 41 is installed underneath the lamp base 2, the through hole 41 is mounted on the rod part 23. The rod part 23 thus goes through the lamp base 4. A limiting element 42 positions the lamp mask 4 on the rod part 23. In this embodiment, the rod part 23 is a screw rod, and the limiting element 42 is a nut.

Figure 5:
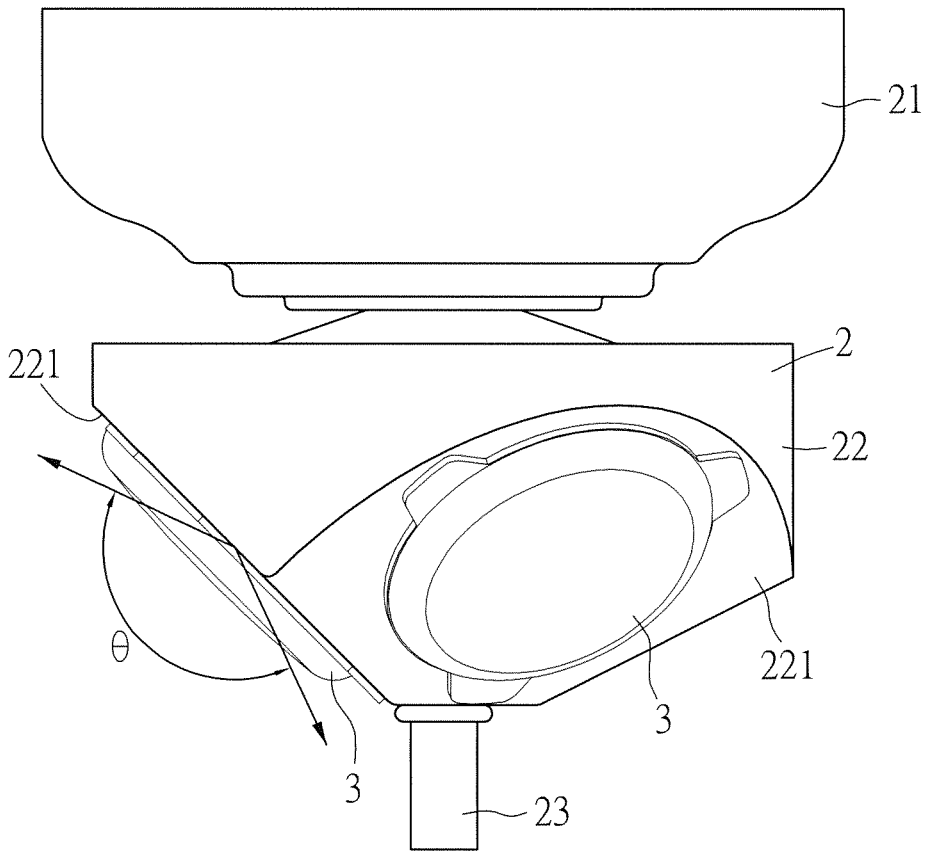
FIG. 5 is a schematic view showing the light-emitting angle of the LED from the slant surface.
Figure 6:
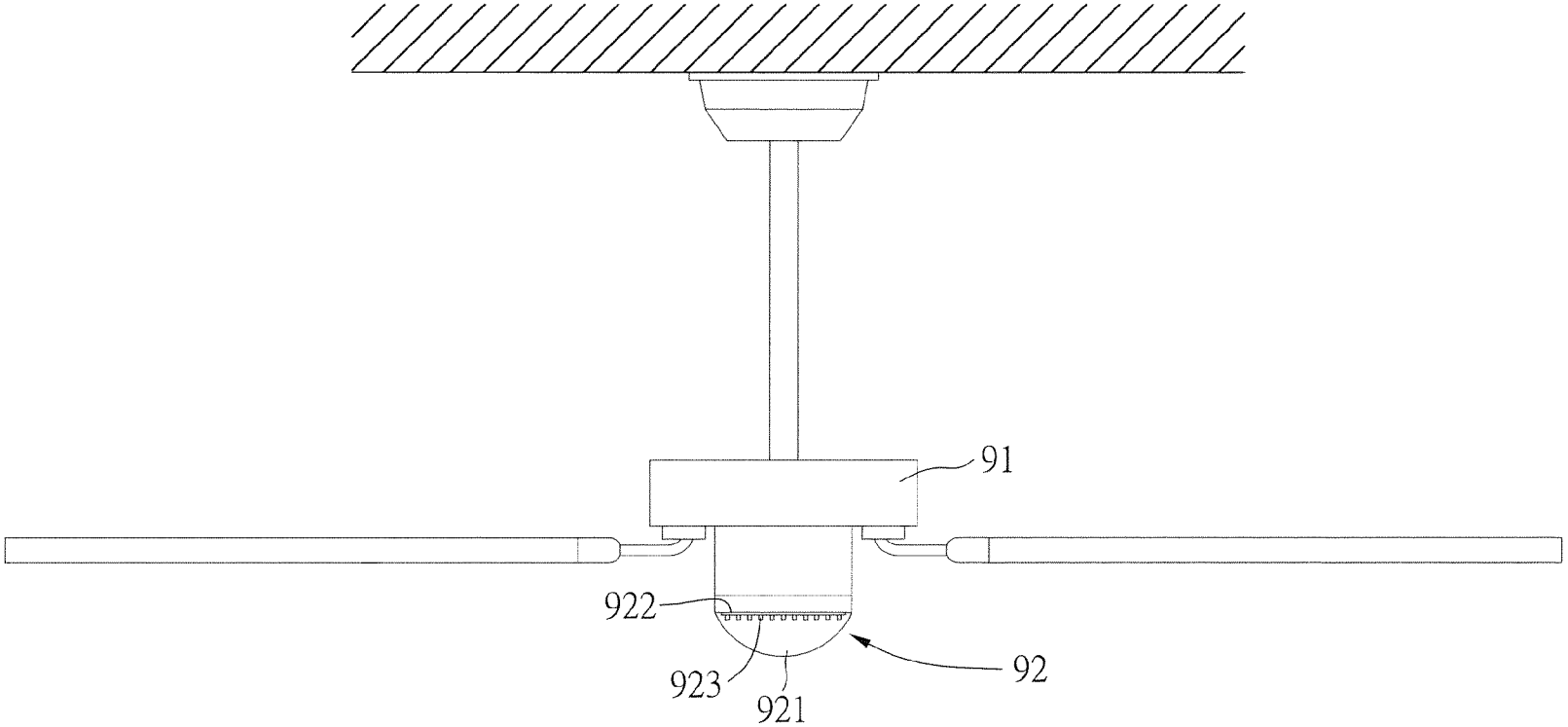
FIG. 6 PRIOR ART
FIG. 6 is a schematic view of a conventional lamp structure for a ceiling fan.

As shown in FIG. 5, when the LED's 3 installed on the slant surfaces 221 emit light, the light rays are also obliquely downward as the corresponding slant surfaces 221. Since the slant surfaces 221 already have an angle with respect to the horizon and the LED's 3 further provide an illumination angle of θ, the invention thus covers a large illumination range.

Although the LED 3 installed on each of the slant surfaces 221 can only illuminate a specific side that the corresponding slant surface 221 faces, the slant surfaces 221 in this embodiment are sufficient to cover all directions. Therefore, all the LED's 3 can illuminate 360 degrees around the installing part 22, so that all directions inside the room can obtain sufficient and homogeneous light. The light-emitting angle provided by the LED's 3 can even reach above the lamp base.

According to the above description, it is seen that the advantage of the invention is in the slant surfaces 221 on the installing part 22 of the lamp base 2. When the LED's 3 emit light, the ceiling fan lamp device can provide homogenous illumination that covers a wide angle. In comparison with the prior art, the invention solves the problem that the light intensity becomes weaker at the wider angles.

Not only can the disclosed lamp structure for the ceiling fan have slant surfaces 221 symmetrically on the installing part 22 of the lamp base 2, the bottom end of each of the slant surfaces 221 may also have a plane facing the ground directly (not shown). This plane can be provided with the above-mentioned LED 3 that strengthens and homogenizes the illumination toward the ground.

Moreover, besides a multi-angular conic shape, the installing part 22 of the lamp base 2 can be a flat cone with two slant surfaces (not shown). Such a flat cone is a conic structure like the head of a slotted screwdriver. The two slant surfaces are symmetrically on two opposite sides. When the LED's 3 are installed on the two slant surfaces and emit light, it can still provide homogeneous light that covers a sufficiently wide angle.

Although the invention has been described with reference to specific embodiments, this description is not meant to be construed in a limiting sense. Various modifications of the disclosed embodiments, as well as alternative embodiments, will be apparent to people skilled in the art. Therefore, it is contemplated that the appended claims will cover all modifications that fall within the true scope of the invention.

What is claimed is:

1. A ceiling fan lamp structure installed on a ceiling fan for illumination, comprising:

a lamp base, whose top part has a connecting part to connect to the ceiling fan and an installing part having at least two slant surfaces facing obliquely downward when the lamp base is connected to the ceiling fan, the slant surfaces being provided symmetrically with respect to the lamp base; and at least one light-emitting diode (LED) provided on each of the slant surfaces, with the light-emitting direction of each of the LED's pointing obliquely downward as the corresponding slant surface;

wherein the installing part has a plane at the bottom of each of the slant surfaces and facing directly toward the ground.

2. The ceiling fan lamp structure of claim 1, wherein the installing part of the lamp base has the shape of a multi-angular cone with at least three slant surfaces symmetrically provided around the lamp base.

3. The ceiling fan lamp structure of claim 1, wherein the installing part of the lamp base has the shape of a flat cone with two slant surfaces symmetrically on opposite sides.

4. The ceiling fan lamp structure of claim 1, wherein a lamp mask is provided underneath the lamp base.

5. The ceiling fan lamp structure of claim 4, wherein the bottom part of the lamp base has a rod part extending downward, the lamp mask has a through hole going through the center thereof, and the through hole is mounted on the rod part when the lamp mask is installed underneath the lamp base, with the rod part going through the lamp mask and using a limiting element to position the lamp mask on the rod part.

6. The ceiling fan lamp structure of claim 5, wherein the rod part is a screw rod and the limiting element is a nut.

7. A ceiling fan lamp structure installed on a ceiling fan for illumination, comprising:

a lamp base, whose top part has a connecting part to connect to the ceiling fan and an installing part having at least two slant surfaces facing obliquely downward when the lamp base is connected to the ceiling fan, the slant surfaces being provided symmetrically with respect to the lamp base; and at least one light-emitting diode (LED) provided on each of the slant surfaces, with the light-emitting direction of each of the LED's pointing obliquely downward as the corresponding slant surface;

wherein the installing part of the lamp base has the shape of a multi-angular cone with at least three slant surfaces symmetrically provided around the lamp base.

8. The ceiling fan lamp structure of claim 7, wherein the installing part of the lamp base has the shape of a flat cone with two slant surfaces symmetrically on opposite sides.

9. The ceiling fan lamp structure of claim 7, wherein a lamp mask is provided underneath the lamp base.

10. The ceiling fan lamp structure of claim 9, wherein the bottom part of the lamp base has a rod part extending downward, the lamp mask has a through hole going through the center thereof, and the through hole is mounted on the rod part when the lamp mask is installed underneath the lamp base, with the rod part going through the lamp mask and using a limiting element to position the lamp mask on the rod part.

11. The ceiling fan lamp structure of claim 10, wherein the rod part is a screw rod and the limiting element is a nut.

12. A ceiling fan lamp structure installed on a ceiling fan for illumination, comprising:

a lamp base, whose top part has a connecting part to connect to the ceiling fan and an installing part having at least two slant surfaces facing obliquely downward when the lamp base is connected to the ceiling fan, the slant surfaces being provided symmetrically with respect to the lamp base; and at least one light-emitting diode (LED) provided on each of the slant surfaces, with the light-emitting direction of each of the LED's pointing obliquely downward as the corresponding slant surface;

wherein the installing part of the lamp base has the shape of a flat cone with two slant surfaces symmetrically on opposite sides.

13. The ceiling fan lamp structure of claim 12, wherein a lamp mask is provided underneath the lamp base.

14. The ceiling fan lamp structure of claim 13, wherein the bottom part of the lamp base has a rod part extending downward, the lamp mask has a through hole going through the center thereof, and the through hole is mounted on the rod part when the lamp mask is installed underneath the lamp base, with the rod part going through the lamp mask and using a limiting element to position the lamp mask on the rod part.

15. The ceiling fan lamp structure of claim 14, wherein the rod part is a screw rod and the limiting element is a nut.

* * * * *